United States Patent [19]

Anthone et al.

[11] 4,225,042

[45] Sep. 30, 1980

[54] CONTINUOUS FILM CARRIER WIRE CONNECTING SYSTEM

[75] Inventors: Leo E. Anthone, Little Canada; Sidney J. Berglund, Stillwater, both of Minn.

[73] Assignee: Minnesota Mining and Manufacturing Company, St. Paul, Minn.

[21] Appl. No.: 916,215

[22] Filed: Jun. 16, 1978

[51] Int. Cl.[3] ..... B65D 73/02; B65D 85/00

[52] U.S. Cl. ..... 206/332; 206/486; 206/820; 72/410

[58] Field of Search ..... 206/332, 330, 328, 329, 206/331, 820, 485, 486; 72/410

[56] References Cited

U.S. PATENT DOCUMENTS

| | | | |
|---|---|---|---|
| 2,903,139 | 8/1959 | Penman | 206/332 |
| 3,129,814 | 4/1964 | Cheh et al. | 206/330 |
| 3,707,867 | 1/1973 | Mayala | 72/410 |

*Primary Examiner*—William T. Dixson, Jr.

*Attorney, Agent, or Firm*—Cruzan Alexander; Donald M. Sell; James V. Lilly

[57] ABSTRACT

A crimping system for crimping electrical wire connectors which have a body with a plurality of longitudinal wire receiving openings in one end and a cap telescopically received in one face of the body for movement into the body from an open position to a crimped position to connect wires inserted into the openings. The system includes a carrier strip retaining the aforesaid connectors in open sided receptacles at spaced locations and a hand tool into which the strip is fed for the crimping of the connectors onto wires.

3 Claims, 10 Drawing Figures

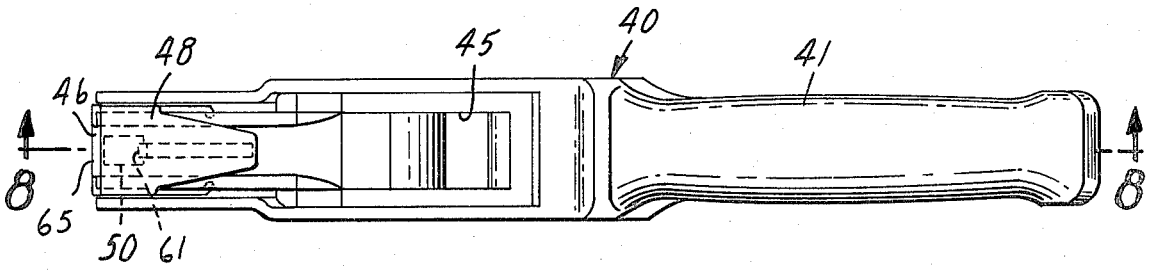
FIG. 7
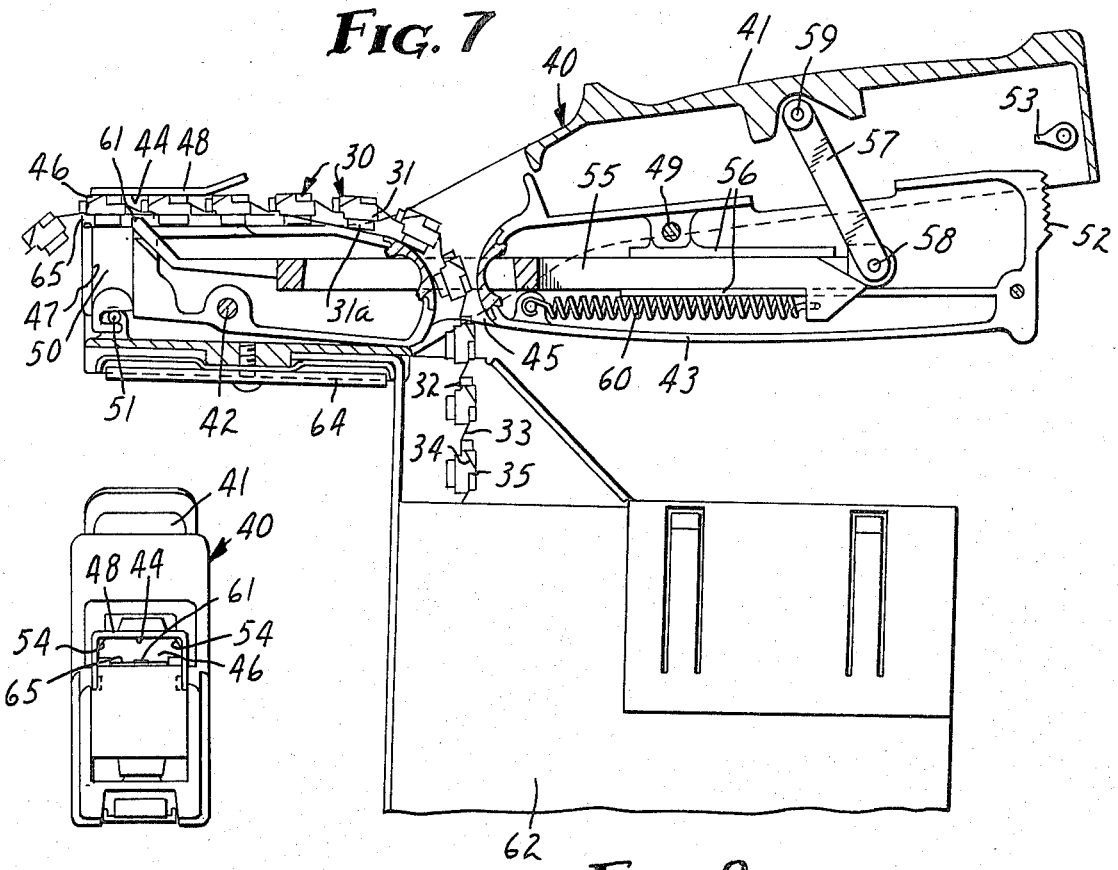
FIG. 10
FIG. 8
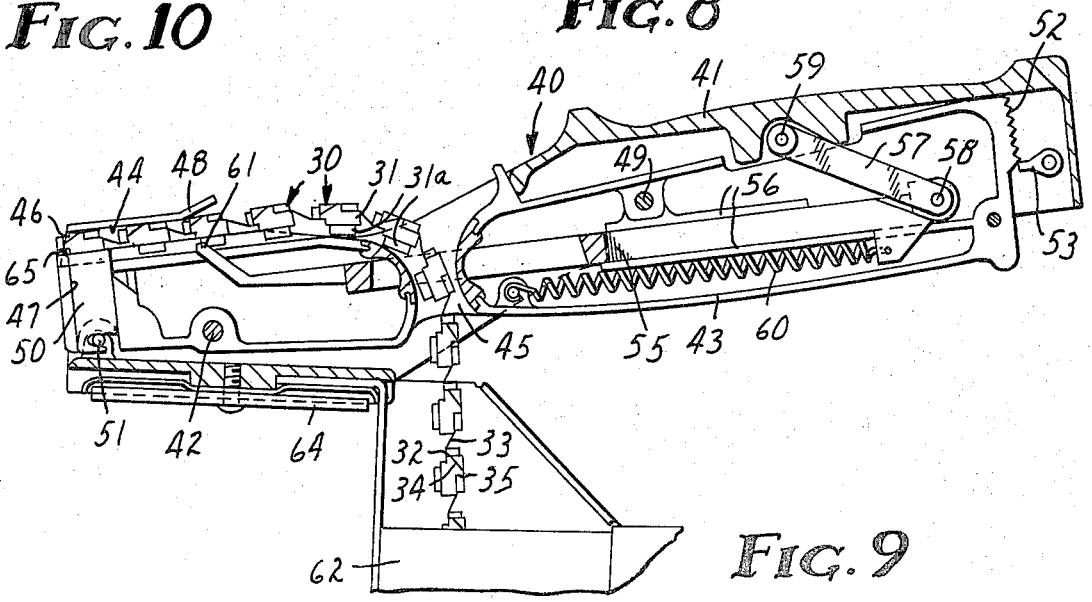
FIG. 9

CONTINUOUS FILM CARRIER WIRE CONNECTING SYSTEM

FIELD OF THE INVENTION

This invention relates to a carrier strip for electrical wire connectors of the type which have a cap that telescopes into a body to connect wires and a wire connecting system utilizing the carrier strip.

BACKGROUND OF THE INVENTION

Certain electrical wire connectors widely used in splicing telephone wires comprise a body portion and a telescoping cap portion moveable toward each other, for example see U.S. Pat. Nos. 3,012,219 and 3,573,713. To insure positive permanent connection between wires inserted in the body portion of this type of connector, the cover portion must be forced into the body while preventing tilting or cocking of the cover.

Prior art tools for crimping the aforementioned connectors are of the pliers type such as that shown in U.S. Pat. No. 3,220,241. The crimping tool thereby provides the needed uniformly distributed pressure but holds only a single connector so the operator is required to handle each connector individually.

Another tool for crimping electrical connectors is shown in U.S. Pat. No. 3,707,867. This tool rigidly holds a connector in position to accept a plurality of wires to be joined. It assures a completed electrical connection by retaining the connector in position until a proper crimp has been made, then forces the properly crimped connector from the tool, and automatically presents a new connector in the proper position.

The tool described in U.S. Pat. No. 3,707,867 utilizes an elongated open-faced trough-like carrier to feed the connectors into the crimping tool. Such a carrier necessitates frequent loading because of the trough's limited capacity. In a typical use situation, a craftsman's hands become greasy from handling grease-filled cables, and it is therefore annoying and frustrating to load the trough at frequent intervals in the proper suggested procedure.

SUMMARY OF THE INVENTION

The present invention provides a carrier strip of a single piece of plastic which inexpensively holds and presents for crimping connectors of the aforementioned type. This carrier strip overcomes the limited capacity of the prior art trough by utilizing the plastic strip in a continuous length which enables the craftsman to select any desired number of connectors to be fed to a crimping station, thus minimizing the handling of connectors.

The crimping system of the present invention minimizes the expense due to loss of operator time which results from the frequent loading and unloading of the tool. This is accomplished by the carrier strip firmly retaining each connector until crimped onto the wires. The strip further incorporates the additional feature of easily releasing the electrical connector after it has been crimped.

The carrier strip comprises a flexible, strip material having at spaced locations along its length similar connector receptacles. The receptacles have a shape complementary to that of a telescoping connector cap in its open position and a major portion of the body of the connector such that the strip material extends partially around the face of the connector body opposite the face receiving the cap to releaseably retain the connectors on the carrier strip while leaving the wire receiving openings in the end of the connector body accessible for insertion of wires. The material utilized in the strip is sufficiently deformable to permit pressure to be applied therethrough to the cap of the connector in order to crimp it into the body.

The crimping tool, for use with the above-mentioned carrier strip, comprises an elongated housing having a longitudinal insertion passage having an inlet and exit, capable of passing the film carrier strip. The housing also contains a vertical channel which intersects the passage at the exit end. Adjacent the passage exit of the housing and opposite the channel is affixed a compression member.

Within the channel itself is slidably fitted a plunger which is movable across the passage toward the compression member. Pivotally attached to the plunger, to facilitate its slidable movement, is an elongate handle member, which is pivotally mounted on the housing. When pressure is applied to the handle member the plunger travels within the channel to apply crimping pressure to the foremost connector which has been positioned at the intersection of the channel and the longitudinal passage opposite the compression member.

An advancing means is positioned in the elongate housing for movement of the carrier strip into alignment with the compression member. The advancing means is pivotally attached to the elongate handle member such that the applying of crimping pressure to the handle activates the advancing means.

The longitudinal passage also contains a check means for preventing retraction of the carrier strip toward the passage inlet once it has been advanced. The check means is positioned to engage the longitudinal edges of the carrier strip when the carrier strip bearing a connector is positioned in the intersection of the channel and the passage.

THE DRAWING

In the drawings

FIG. 7 is a top view of the improved crimping tool for use with the carrier strip of the present invention.

FIG. 8 is a cross-sectional elevational side view of an improved crimping tool for use with a carrier strip of the present invention taken along line 8—8 of FIG. 7.

FIG. 9 is a cross-sectional elevation of the improved tool along line 8—8 of FIG. 7 while it is in the crimping or closed position; and FIG. 10 is a front elevation view of the improved tool of the present invention.

Figure 5:
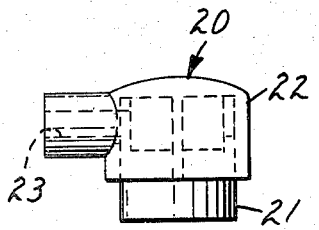
FIG. 5 is an elevational side view of a typical connector prior to crimping.
Figure 6:
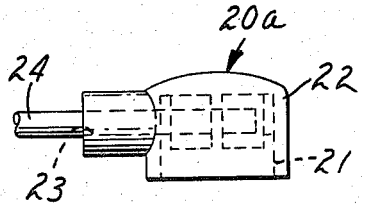
FIG. 6 is an elevational side view of a typical connector crimped onto a pair of wire ends.

Referring to the drawings, and particularly to FIG. 5, there is shown an electrical connector generally designated 20, in the open position. It is comprised of cap 21 which is telescopically received in the body 22 of the electrical connector. The body portion 22 is provided with wire receiving openings 23. FIG. 6 shows an electrical connector 20 which has had wires 24 inserted and then crimped into the closed position to electrically connect the wires.

Figure 3:
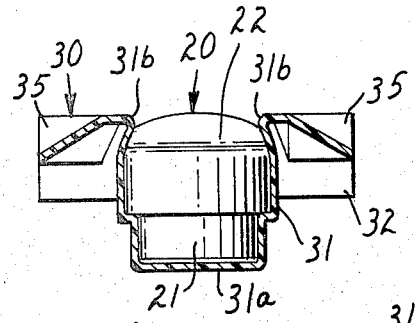
FIG. 3 is a transverse cross-sectional elevation taken approximately along line 3—3 of FIG. 1.
Figure 1:
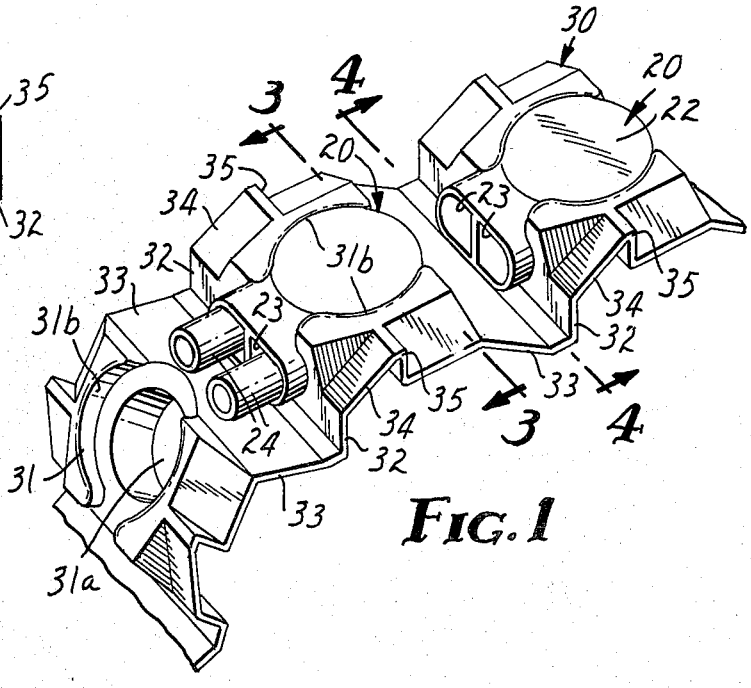
FIG. 1 is a perspective view of a carrier strip of the present invention containing a plurality of telescoping electrical connectors.
Figure 4:
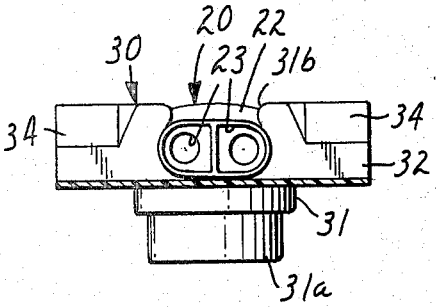
FIG. 4 is a transverse cross-sectional elevation taken approximately along line 4—4 of FIG. 1.

Referring to FIG. 1, the carrier strip, generally designated 30, comprises a flexible strip material formed at spaced locations along its length with similar connector receptacles 31. As seen in FIGS. 3 and 4, each receptacle 31 has a portion 31*a* shaped complementary to that of the connector cap 21 in its open position. The receptacles 31 are formed such that the strip material will extend partially around the face of the connector body opposite the face of the receiving cap, this partial extension being designated 31*b* in FIG. 3. The partial extension 31*b* of the strip material allows for the connector 20 to be releaseably retained in the strip while simultaneously leaving the wire receiving openings 23 accessible for insertion of wires in a direction parallel to the length of the carrier strip, as seen in FIG. 4. It is contemplated that the carrier strip retain the connectors such that wire receiving openings of the connector are accessible from other directions.

The strip material is sufficiently deformable to permit pressure to be applied through the receptacle 31 at portion 31*a* to the cap 21 of connector in order to crimp it into the connector body 22. Numerous materials are known to the art which exhibit sufficient rigidity to retain the connectors 20 in the receptacles 31 while at the same time having the flexibility and deformability required to permit crimping of the connector cap 21 into the body 22. Suitable materials are, for example, plastic, foil, non-woven webs and pulpslurries. The presently preferred material for the carrier strip of the present invention is low density polyethylene.

Figure 2:
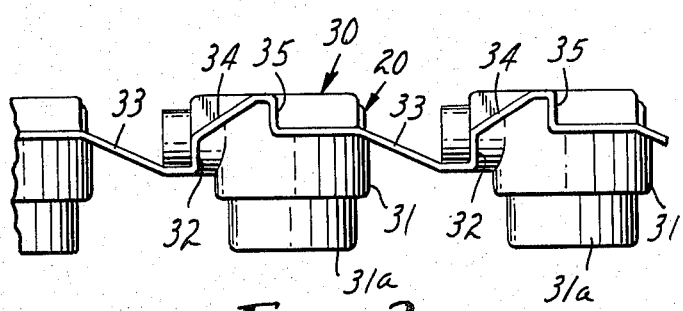
FIG. 2 is a side elevation view of the carrier strip of FIG. 1.

Referring back to FIGS. 1 and 2, the carrier strip 30 is generally planar across its face opening into each of the receptacles 31. The carrier strip 30 is formed with a first step 32 adjacent the connector receptacle 31 at the end where the wire receiving openings 23 in the connector body 22 are accessible.

A planar portion 33 extends between receptacles and is inclined in a direction progressing toward the plane opening into the receptacles from the first step 32 to the adjacent receptacle.

A pair of second inclined portions 34, one at each edge of the carrier strip, each begins at the midpoint of the first step 32 and terminates at the midpoint of the receptacle 31 in a second step 35. These inclined portions 34 and steps 35 of the carrier strip 30 in conjunction with check means 54, discussed below, of the hand tool 40 ensures that during the insertion of wires into the wire receiving portion of the electrical connector retraction of the connector from the optimum crimping position is prevented.

It is preferred that the carrier strip 30 of the present invention be supplied in rolled continuous strips with the electrical connectors properly oriented thereon. The preferred method of manufacturing a continuous strip, when the material is polyethylene is on a continuous thermoforming vacuum packaging machine. This machine is of the type where a thermoformable web is fed onto an aluminum drum which has molds for the receptacles, steps and inclined portions. The drum with the plastic web thereon is passed along a curved radial heating zone which contains various forming sections. A vacuum is drawn within the mold as it progresses through the heating zone. The film is gradually drawn into the molds, then cooled and removed. The connectors are then machine fed into the receptacles and the strips are rolled in the desired length. It is contemplated that other means of manufacture would be used depending on the material selected for the carrier strip.

FIG. 8 shows the tool for use in the crimping system of the present invention. The tool comprises an elongate handle 41, that is pivotally connected by a pin 42 to a channel-shaped housing member 43. The housing 43 has a longitudinal insertion passage 44 for receiving the film carrier strip 30, the passage having an inlet 45 and an exit 46. Intersecting the longitudinal insertion passage at the outlet end 46 is a channel 47. Positioned directly above the channel 47, is a compression member 48.

In the preferred embodiment, the housing member 43 comprises a left and right shell cast of metal and held together by assembly pin 49. The housing portions in the preferred embodiment are contoured to provide a comfortable grip and the lower portion may be further provided with finger grips to prevent the hand from slipping along the tool.

As shown in FIG. 8, a crimping plunger 50 is terminally pivotally mounted on the handle member 41 by pin 51 for slideable movement within channel 47 toward the compression member 48 in response to movement of the handle 41 and housing 43 toward each other. When the plunger 50 is moved into the passage 44, the plunger 50 is pressed against connector cap portion 21 which in turn is forced into connector body 22. An uncrimped connector 20 shown in FIG. 5 assumes the form of the crimped connector 20*a* as depicted in FIG. 6 upon completion of a crimping operation. The travel of plunger 50 into the passage 44 is sufficient to provide desired movement of the cap 21 into the body 22 and the plunger movement is terminated by contact of the handle portions with each other.

During the crimping operation the plunger pivot pin 51 travels in an arc about handle pivot pin 42, riding in an elongated hole in the plunger 50. This arrangement compensates for movement of pin 51 and allows substantially vertical movement of plunger 50 in channel 47.

To ensure that the connector is completely crimped once the crimping operation is started, the elongate housing 43 is equipped with rachet teeth 52 and the handle 41 with a pawl 53. Once the housing 43 is pressed into the handle 41, the closing motion has to be completed in order that the pawl 53 can change direction at the lower portion of the teeth 52, as shown in FIG. 9, to allow the handle and housing to return to their initial positions.

Within the longitudinal passage 44 is a check means 54 which prevents retraction of a carrier strip toward the passage inlet 45. The check means 54 is positioned to contact the longitudinal edges of the carrier strip 30 and comprises a pair of projections 54 extending from the compression member, one at each edge of the passage. The passage 44 at the projections 54 is spaced so as to compress the edges of the advancing strip. As the carrier strip 30 moves toward the passage exit the projections 54 engage the inclined portions 34 and compress the edges of the strip until the connector is in crimping position whereupon the inclined portions 34 pass the projections 54 and the carrier strip 30 expands to its original form. The second step portions 35 of the carrier strip then act in conjunction with the check means 54 projecting behind the second step 35 to prevent retraction of the carrier strip toward the passage inlet.

For the automatic movement of a connector 20 on a carrier strip to the crimping position at the passagechannel intersection, the hand tool 40 is equipped with an advancing means. The advancing means consists of a slide bar 55 which is slideably fitted in retaining tracks 56 in the elongate housing member 43. In the preferred embodiment, the slide bar 55 is a one piece plastic unit which is apertured at its intersection with the carrier strip passage 44 to permit movement of the carrier strip 30 through the slide bar 55. Slide bar 55 is terminally pivotally attached to a lever arm 57 by a pin 58. The opposite end of lever arm 57 is pivotally attached to the handle 41 by a pin 59. The lever arm 57 is mounted such that when the handle 41 and housing member 43 are squeezed together it causes the slide bar 55 to retract, as shown in FIG. 9. A tension spring 60, having one end attached to the rear end of the slide bar 55 and the other end attached to the housing 43, is elongated during the retraction of the slide bar and acts to return the slide to its original position when the pressure is released.

During retraction a nose portion 61 of the slide bar 55 is deflected downward and snaps up behind the next receptacle 31 of the carrier strip 30 (FIG. 9). As the slide bar is returned to the rest position depicted in FIG. 8, the nose portion 61 pushes on the receptacle 31 and advances the connector containing strip 30. This advances the portion of the strip adjacent the receptacle containing the just crimped connector past the check means 54, while simultaneously positioning the advanced connector in the channel-passage intersection for crimping and against a stop 65.

Initially the carrier strip is hand fed from a supply source 62 through the passage 44 into the channelpassage intersection. After loading the hand tool the wires which are to be crimped are inserted into the exposed wire receiving openings 23. The carrier strip extending out of the passage exit provides a funneling effect which aids in the guidance of the wires into the opening.

The carrier strip supply source 62, shown in FIGS. 8 and 9, is a cartridge belt type supply which is attached to the tool by a clip 64 for a more mobile use. It is contemplated that the tool may also be attached at the clip to a stand with the supply source being a larger source of connectors.

What is claimed is:

1. A carrier strip for electrical wire connectors having a body with a plurality of longitudinal wire receiving openings in one end and a cap telescopically received in one face of the body for movement into the body from an open position to a crimped position to connect wires inserted into the openings, comprising:

a one piece flexible strip material formed at spaced locations along its length with similar connector receptacles, said carrier strip being generally planar across the face thereof opening into each of said receptacles, and said carrier strip being formed with a first step adjacent the end of the connector receptacle at which the wire receiving openings in the connector body are accessible to provide the access to the wire receiving openings, a planar portion between connector receptacles, and having at least one compressible longitudinal edge alongside said connector receptacles, each of said connector receptacles having a shape complementary to that of the cap in its open position and a major portion of the body of a said connector, such that the strip material will extend partially around the face of the connector body opposite the face receiving the cap to releaseably retain the connector on said carrier strip while leaving the wire receiving openings in the end of the body accessible for insertion of wires, said strip material being sufficiently deformable to permit pressure to be applied therethrough to the cap of a said connector to crimp it into the body.

2. The carrier strip of claim 1 wherein said planar portion between connector receptacles is inclined in a direction toward the plane of said generally planar face of the opening into said receptacles progressing from a said first step adjacent a receptacle to the next receptacle.

3. The carrier strip of claim 1 wherein said compressible longitudinal edges alongside said connectors incline from the midpoint of said first step to the planar face of said flexible strip in a direction away from the wire receiving opening and terminating in a second step positioned approximately aligned with the midpoint of said connector receptacles.

* * * * *